US012780500B2

(12) United States Patent
Kimbrough

(10) Patent No.: US 12,780,500 B2
(45) Date of Patent: Nov. 3, 2026

(54) COLLAPSIBLE CONTAINER

(71) Applicant: Pure Fishing, Inc., Spirit Lake, IA (US)

(72) Inventor: Jordan Kimbrough, Peoria, IL (US)

(73) Assignee: Pure Fishing, Inc., Spirit Lake, IA (US)

( * ) Notice: Subject to any disclaimer, the term of this patent is extended or adjusted under 35 U.S.C. 154(b) by 0 days.

(21) Appl. No.: 18/449,387

(22) Filed: Aug. 14, 2023

(65) Prior Publication Data

US 2024/0051712 A1 Feb. 15, 2024

Related U.S. Application Data

(60) Provisional application No. 63/371,418, filed on Aug. 15, 2022.

(51) Int. Cl.

| | |
|---|---|
| ***B65D 25/28*** | (2006.01) |
| ***B65D 21/08*** | (2006.01) |
| ***B65D 43/02*** | (2006.01) |

(52) U.S. Cl.

CPC ..... *B65D 25/2867* (2013.01); *B65D 21/086* (2013.01); *B65D 43/0202* (2013.01);
(Continued)

(58) Field of Classification Search

CPC ..... B65D 25/2867; B65D 21/086; B65D 43/0202; B65D 2543/00194
(Continued)

(56) References Cited

U.S. PATENT DOCUMENTS 592,778 A * 11/1897 Hargrave ..... A45C 3/00 220/756
1,037,985 A * 9/1912 Rengstorf ..... B65D 21/086 220/756

(Continued)

FOREIGN PATENT DOCUMENTS

CA 2703372 A1 * 11/2011 ..... A45C 11/00
CN 215922842 U 3/2022

(Continued)

OTHER PUBLICATIONS https://www.homedepot.com/p/reviews/HOMZ-Store-N-Stow-12-Gal-Collapsible-Storage-Container-with-Wheels-in-Grey-and-Teal-Base-with-Clear-Lid-4-Pack-2211046DC-04/308848854/1 Accessed Jul. 2022.

(Continued)

*Primary Examiner* — Orlando E Aviles
*Assistant Examiner* — Niki M Eloshway
(74) *Attorney, Agent, or Firm* — Husch Blackwell LLP

(57) ABSTRACT

The present disclosure relates generally to a collapsible container having a top section, a bottom section, and a middle section between the top section and the bottom section. The top section and the bottom sections can be formed from a rigid material, for example, plastic. The middle section can be formed from a flexible material that can fold over onto itself, allowing the container to collapse for easy and compact storage. The container can further comprise handles rotatably coupled to the top section that, when rotated downward, can releasably couple to handle holds of the bottom section, thereby providing rigidity to the container in its expanded configuration to prevent or reduce the occurrence of unintentional collapse. In an upward position, the handles can fit together to create a single
(Continued)

carrying point. The handles are also configured to slide into the footprint of the container to allow for compact storage.

12 Claims, 6 Drawing Sheets

(52) U.S. Cl.
CPC ..... *B65D 2525/285* (2013.01); *B65D 2543/00194* (2013.01)

(58) Field of Classification Search
USPC ..... 220/666, 759, 760, 770
See application file for complete search history.

(56) References Cited

U.S. PATENT DOCUMENTS

| | | | | |
|---|---|---|---|---|
| 4,071,939 | A * | 2/1978 | Bock | B65D 25/32 29/434 |
| 5,337,910 | A * | 8/1994 | Picozza | A23B 7/10 220/756 |
| 5,469,986 | A * | 11/1995 | Jang | B65D 21/062 220/772 |
| 6,431,406 | B1 * | 8/2002 | Pruett | B65D 1/0292 220/666 |
| 7,234,599 | B2 * | 6/2007 | Hassell | B65D 21/062 206/509 |
| D642,870 | S | 8/2011 | Whitlock | |
| 10,196,169 | B2 * | 2/2019 | Tsui | D06F 95/002 |
| D880,162 | S | 4/2020 | Zemel et al. | |
| 11,191,331 | B2 | 12/2021 | Zemel et al. | |
| 11,279,519 | B2 | 3/2022 | Tsui | |
| 2010/0133281 | A1 * | 6/2010 | Wojcik | B65D 21/08 220/666 |
| 2015/0251795 | A1 | 9/2015 | Tsui | |
| 2016/0059990 | A1 * | 3/2016 | Patikas-Bryant | B65D 21/086 220/523 |
| 2019/0373994 | A1 * | 12/2019 | Zemel | A45C 5/045 |
| 2022/0119152 | A1 | 4/2022 | Blankinship et al. | |
| 2022/0227530 | A1 * | 7/2022 | Cheetham | B65D 1/0292 |

FOREIGN PATENT DOCUMENTS

| | | | |
|---|---|---|---|
| DE | 10008118 | A1 | 8/2001 |
| GB | 2324716 | A | 11/1998 |
| WO | 1998046489 | A1 | 10/1998 |

OTHER PUBLICATIONS https://www.amazon.com/Collapsible-Soaking-Remover-Foldable-Pedicure/dp/B08J82B662/ref=asc_df_B08J82B662/?tag=hyprod-20&linkCode=df0&hvadid=508811616153&hvpos=&hvnetw=g&hvrand=13653024341109895009&hvpone=&hvptwo=&hvqmt=&hvdev=c&hvdvcmdl=&hvlocint=&hvlocphy=9022120&hvtargid=pla-1262875164134&psc=1 Accessed Jul. 2022.

* cited by examiner

COLLAPSIBLE CONTAINER

CROSS-REFERENCE TO RELATED APPLICATIONS

This application claims priority to U.S. Provisional Patent Application Ser. No. 63/371,418, filed Aug. 15, 2022, the entire contents of which are hereby incorporated by reference.

FIELD OF INVENTION

The present disclosure relates to collapsible containers. In particular, the present disclosure relates to collapsible containers having at least one handle that is releasably couplable to the container in multiple locations to provide increased rigidity to the container in an expanded configuration.

BACKGROUND OF THE INVENTION

Large containers can be difficult to store. Consumers looking for a compact storage solution turn to, in some instances, collapsible containers. However, typical collapsible containers, when opened, can be too flexible and may tend to collapse unintentionally, sometimes without much provocation.

The present disclosure seeks to provide a collapsible container having increased stability to prevent unintentional collapse.

SUMMARY OF INVENTION

The present disclosure generally relates to a container that can collapse and reduce its overall footprint for storage purposes. The container can include at least one handle that can be rotated into different positions to stabilize the container, allow for carrying of the container, or provide easy and compact storage. For example, the handle can rotate downwardly toward the container and snap into the base while the container is in the expanded configuration. In this way, the handle provides a rigid connection between the top and bottom of the container to help prevent the undesired collapse of the mid-section of the container.

The handle can also rotate upwardly into an upward position and optionally snap together with another handle to create a single carrying point. In some embodiments, the handle can slide horizontally into the container footprint for nesting when the container is in the collapsed configuration.

These and other aspects and advantages of the present invention will become apparent to those skilled in the art after considering the following detailed description in connection with the accompanying drawings.

Figure 1:
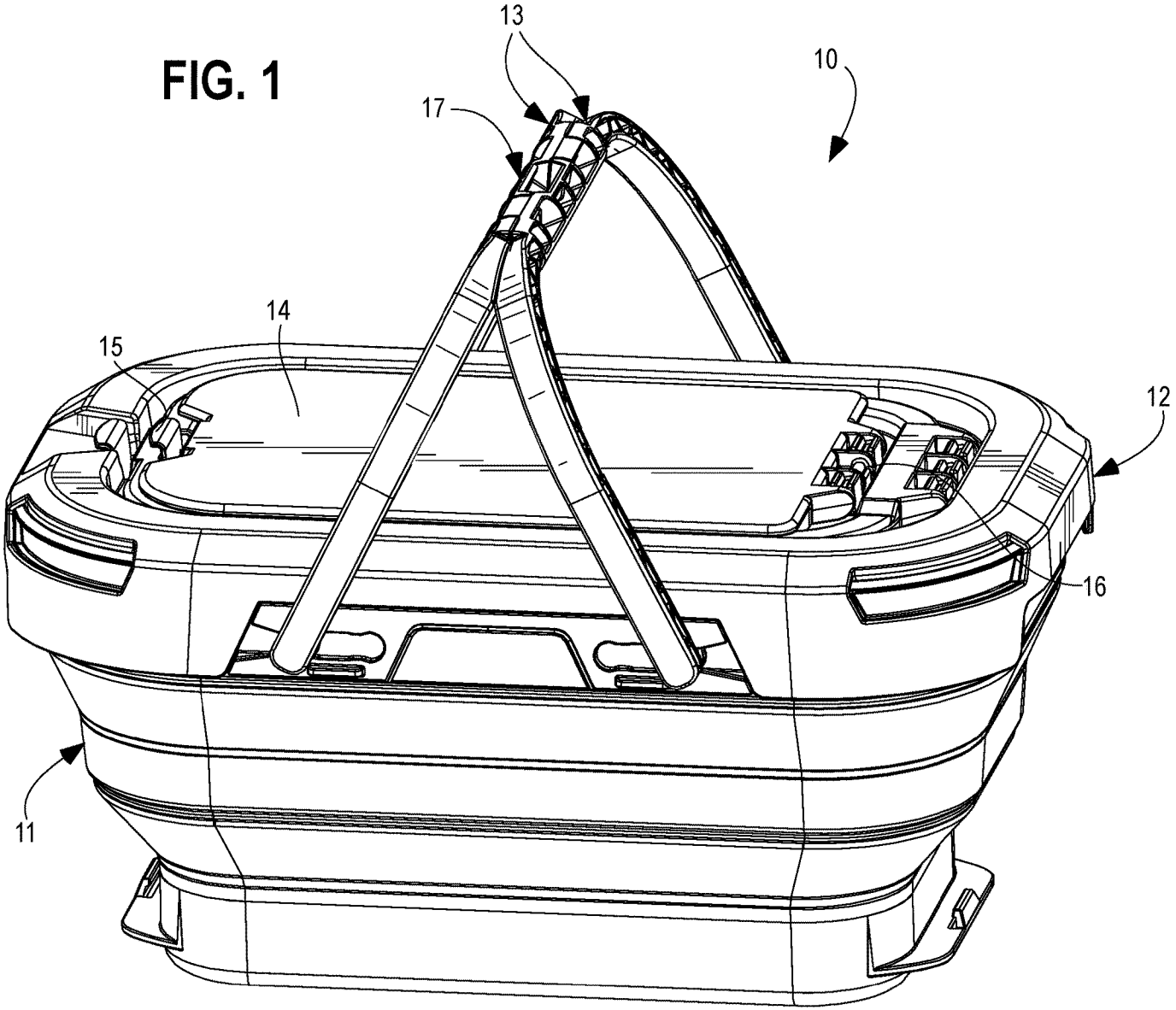
FIG. 1 is a perspective view of the collapsible container according to one embodiment of the present disclosure with the handles in an upright position and a lid.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Referring now to FIG. 1, an embodiment of a collapsible container according to the present disclosure is generally indicated at reference numeral 10. The container 10 broadly includes a body 11, a lid 12, and at least one handle 13. The illustrated embodiment includes two handles 13. A portion of the body 11 is preferably made from a flexible material which allows the body to collapse to reduce a height of the container 10, making for easy and compact storage.

The handles 13 perform a variety of functions due to their ability to rotate to a variety of positions. For example, when multiple handles 13 are utilized, the handles 13 can be rotated into an upward position and couple with one another via, for example, a snap-fit connection, a magnetic connection (e.g., through magnets contained within the handles 13 themselves), or by any other acceptable means known in the art to allow for a simple carrying point. As will be explained in more detail below, the lid 12 can also include, in some embodiments, a compartment cover 14 hingedly coupled to the lid 12 via a latch 15 and opposing hinge 16. In yet other embodiments, a lid may be provided that attaches directly to the container 10 that is not hinged. The manners and configurations of lid arrangements is not limited by the application, and known or foreseeable lid structures are envisioned.

Typically, the handles 13 couple with each other at an intermediate portion 17 thereof (i.e., the portion between both ends of the handle), although in other embodiments, the handles 13 may couple with one another at a different location. The handles 13 may prevent the unintentional collapse of the body 11 in a downward position and may also be able to slide into the footprint of the body 11 in a horizontal stowed position for compact storage purposes.

Figure 2:
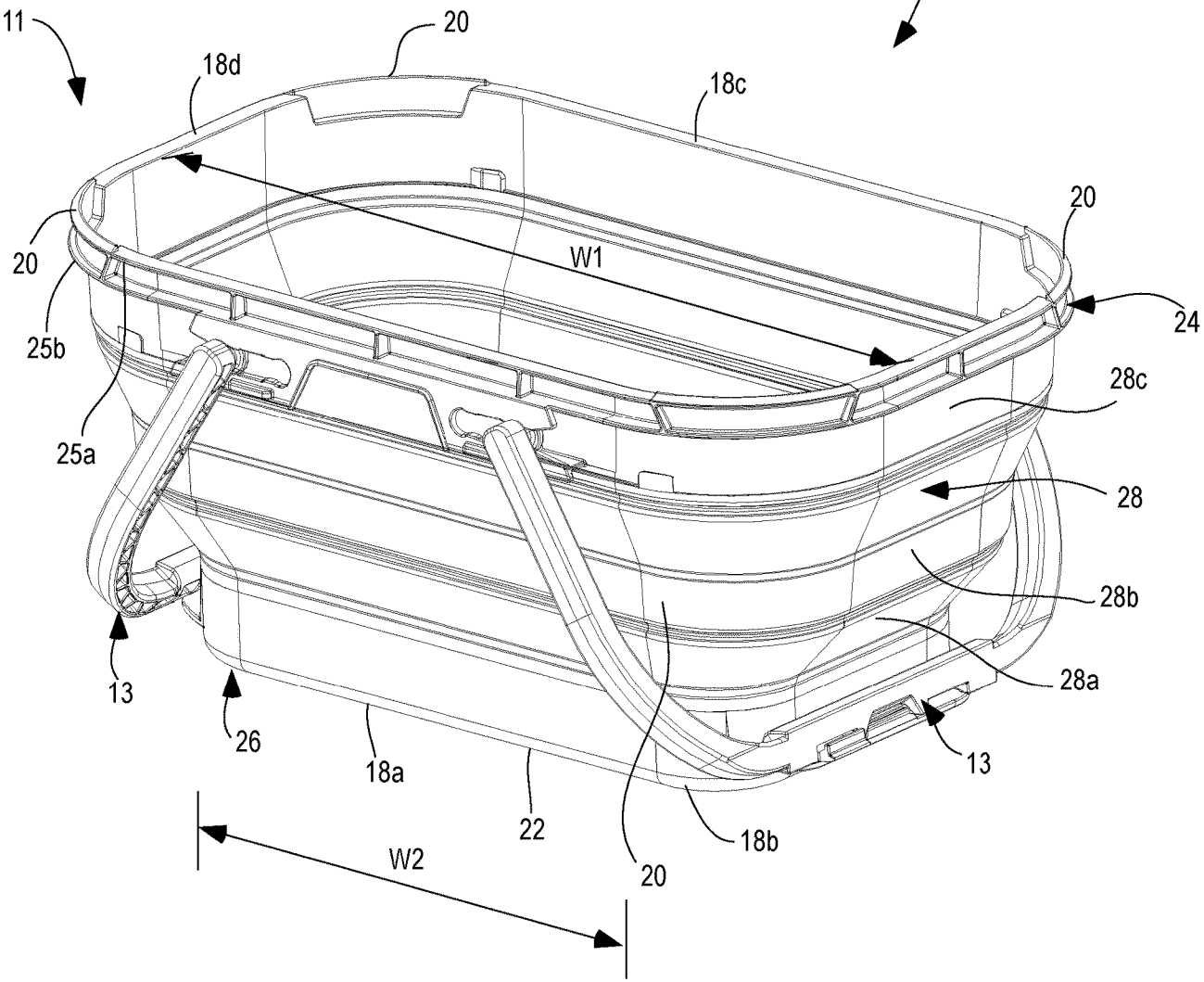
FIG. 2 is a perspective view of the collapsible container of FIG. 1 with the handles in a downward position and the lid removed.

Turning now to FIG. 2, the body 11 can include four sides. A first side 18*a* may be provided with a second side 18*b* adjacent to and generally perpendicular to the first side 18*a*. A third side 18*c* may be adjacent to and generally perpendicular to the second side 18*b* and generally parallel to the first side 18*a*. A fourth side 18*d* may be adjacent to and generally perpendicular to the first side 18*a* and the third side 18*c*, and generally parallel to the second side 18*b*. In this way, the body 11 can have a generally rectangular or square shaped horizontal cross section. Adjacent sides can meet each other at a corner portion 20. In some embodiments, the corner portion 20 can be rounded. The container 10 can include a base 22 that is coupled to a bottom portion of each of the sides 18*a*, 18*b*, 18*c*, 18*d*. Thus, the base 22 with the sides 18*a*, 18*b*, 18*c*, 18*d* define an interior volume. The base 22 can be generally planar.

The sides 18*a*-18*d* each may include a top portion 24, a bottom portion 26, and an intermediate portion (or middle portion) 28 between the top portion 24 and the bottom portion 26. The top portion 24 can terminate in an upper rim 25*a*. A lower rim 25*b* may also be present below the upper rim 25*a* in the top portion 24.

A first angular intermediate segment 28*a* may be above the bottom portion 26, a second generally vertical intermediate segment 28*b* may extend upwardly from the first angular intermediate segment 28*a*, and a third angular intermediate segment 28*c* may be positioned below the top portion 24. Other embodiments may include more or fewer intermediate segments, or it may include top and bottom portion segments. In the illustrated embodiment, because the intermediate segments 28*a*, 28*c* may be angled outwardly, a width w1 of the top portion 24 can be greater than a width w2 of the bottom portion 26.

In various embodiments, the top portion 24 and the bottom portion 26 can be constructed of a relatively rigid material, for example, plastic. The intermediate portion 28 can be constructed of a flexible and resilient material. The flexible and resilient material is intended to be elastically deformable and capable of folding over on itself. Examples of flexible and resilient materials include elastomeric materials, such as silicone.

Figure 3:
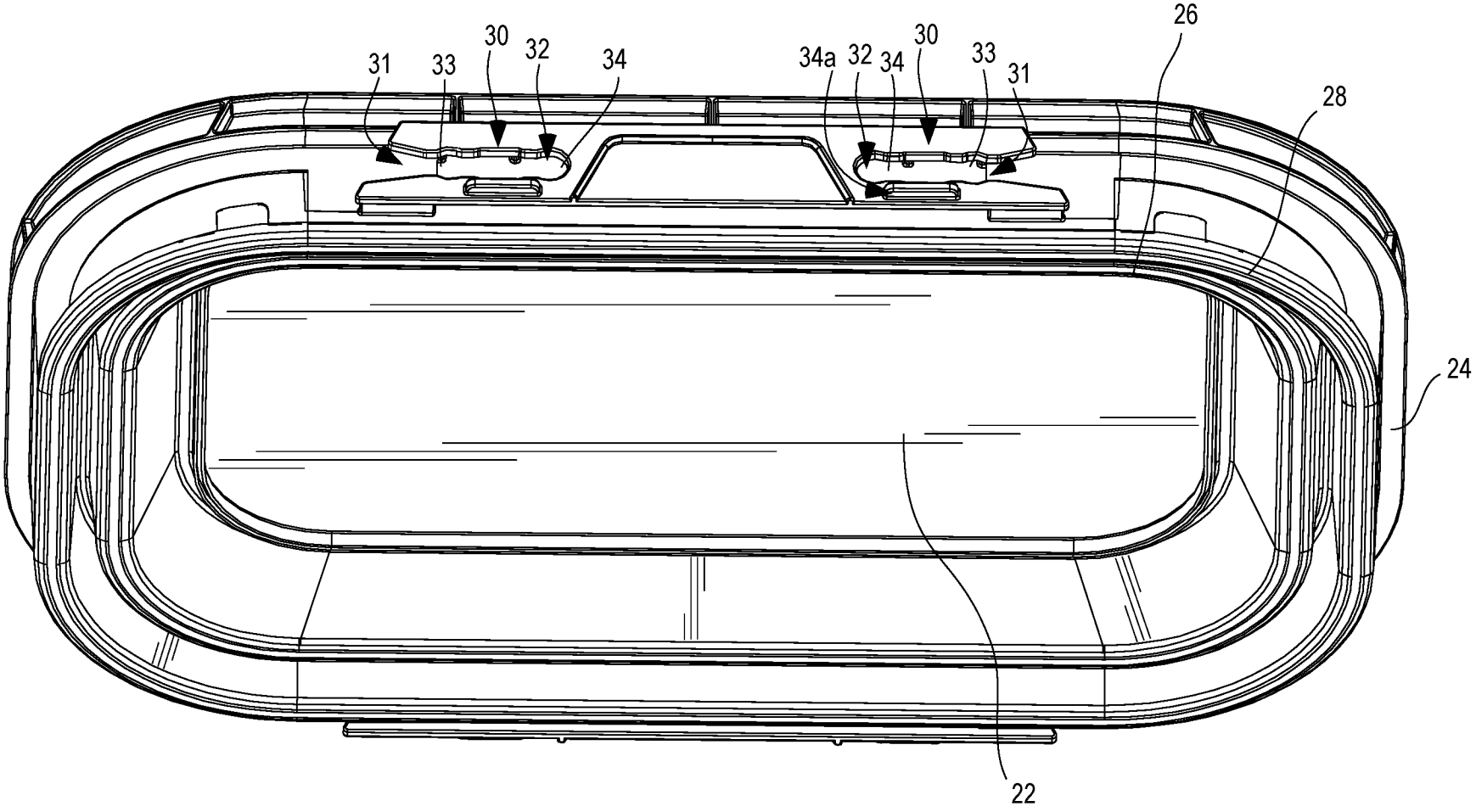
FIG. 3 is a perspective side view of the collapsible container of FIG. 1 in the collapsed configuration and with the handles removed.

Because the width w1 of the top portion 24 is greater than the width w2 of the bottom portion 26, when the intermediate portion 28 folds over on itself, thereby reducing a height of the container 10, the top portion 24 can nest outside of the bottom portion 26. In this position, as illustrated in FIG. 3, the folded intermediate portion 28 may be nested in between the top portion 24 and the bottom portion 26.

The top portion 24 can include handle attachment channels 30 in which the handles 13 may be secured. The channels 30 may include a first open end 31 and a second closed end 32. Near each of the open ends 31 a first rotation portion 33 may be provided in which the handles 13 may rotate to either of a "carry" or "expanded/downward" position, as set out herein. A second rotation portion 34 may also be provided for storing or nesting the handles 13. A storage tab 34*a* may hold handles 13 parallel to the top portion 24 when in the collapsed position. The rotation portions 33, 34 preferably include interference bumps (not illustrated) which may keep the handles 13 substantially in place when they are in the carry or collapsed positions.

Figure 4:
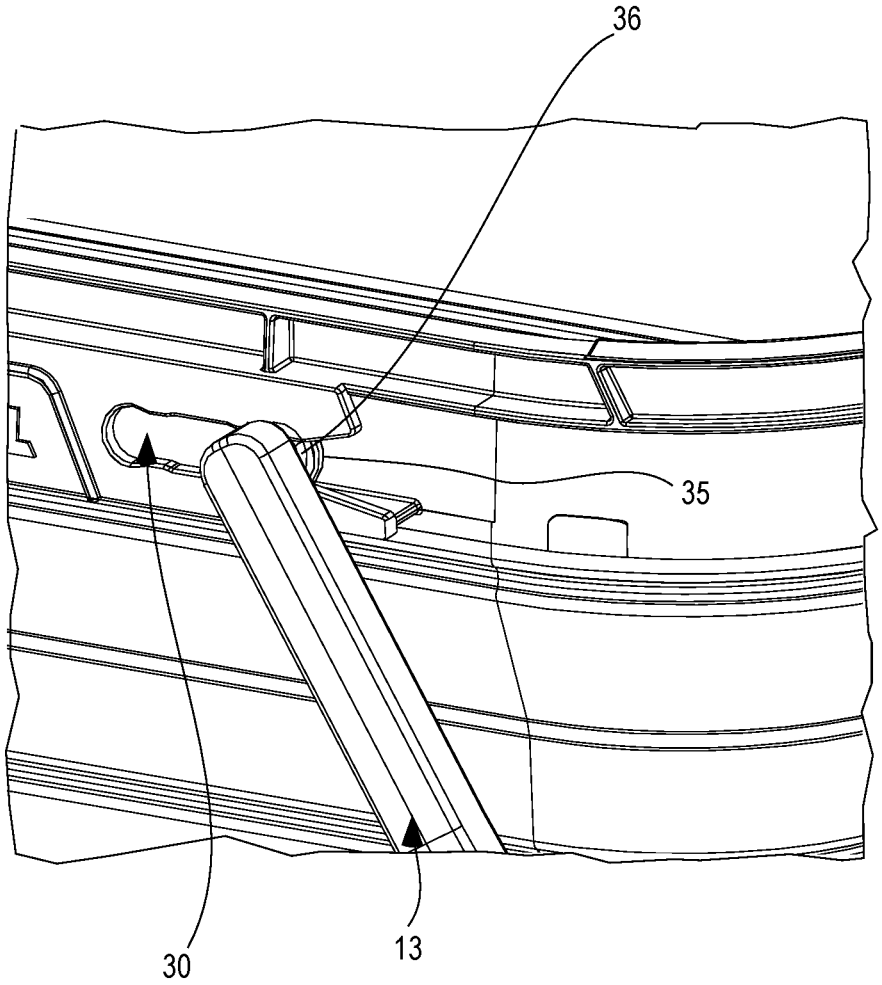
FIG. 4 is an enlarged perspective view of the handle attachment channel of the container of FIG. 1 with a handle attached.

Each end of the handle 13 can end in a knob 35 coupled to a narrower shaft 36 (see FIG. 4). The shaft 36 can have a diameter that is slightly smaller than the width of the channel 30. In practice, the knob 35 can slide into the first open end 31 of the attachment channel 30 (see FIG. 3). The shaft 36 can slide along the channel 30 until it abuts the second closed end 32. When the handles 13 are collapsed, the shaft 36 and knob 35 may nest in the second rotation portion 34. When the handles 13 are in the carry position (like in FIG. 1), the shaft 36 and knob 35 may nest in the first rotation position 33. When the lid 12 is attached, the handles 13 are further secured to the container 10, reducing the likelihood of inadvertent removal.

Figure 5:
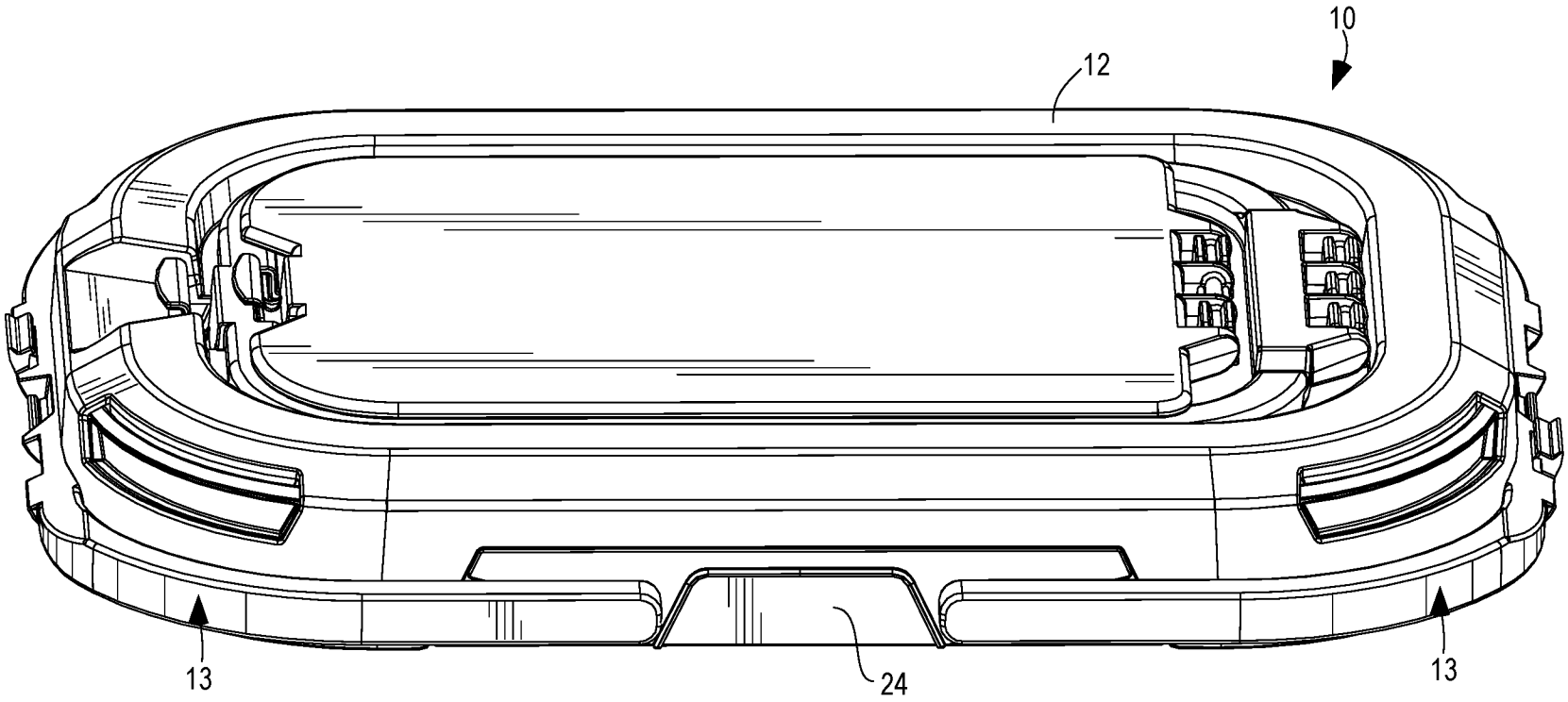
FIG. 5 is a side perspective view of the collapsible container of FIG. 1 in the collapsed configuration and the handles in a stowed position.

As shown in FIG. 5, the handles 13 can slide inwardly toward the second closed end 32 and can be rotated to a horizontal stowed position so that they are generally parallel with the plane of the top portion 24 of the container, thereby reducing the overall footprint of the container 10, which may be especially advantageous when the container 10 is in a collapsed configuration. Because of this, in some embodiments, the geometry of the handles 13 may mirror the geometry of the top section 24 of the body 11 and thereby surround and abut the shape of the top section 24 of the body 11 in the stowed position.

Figure 6:
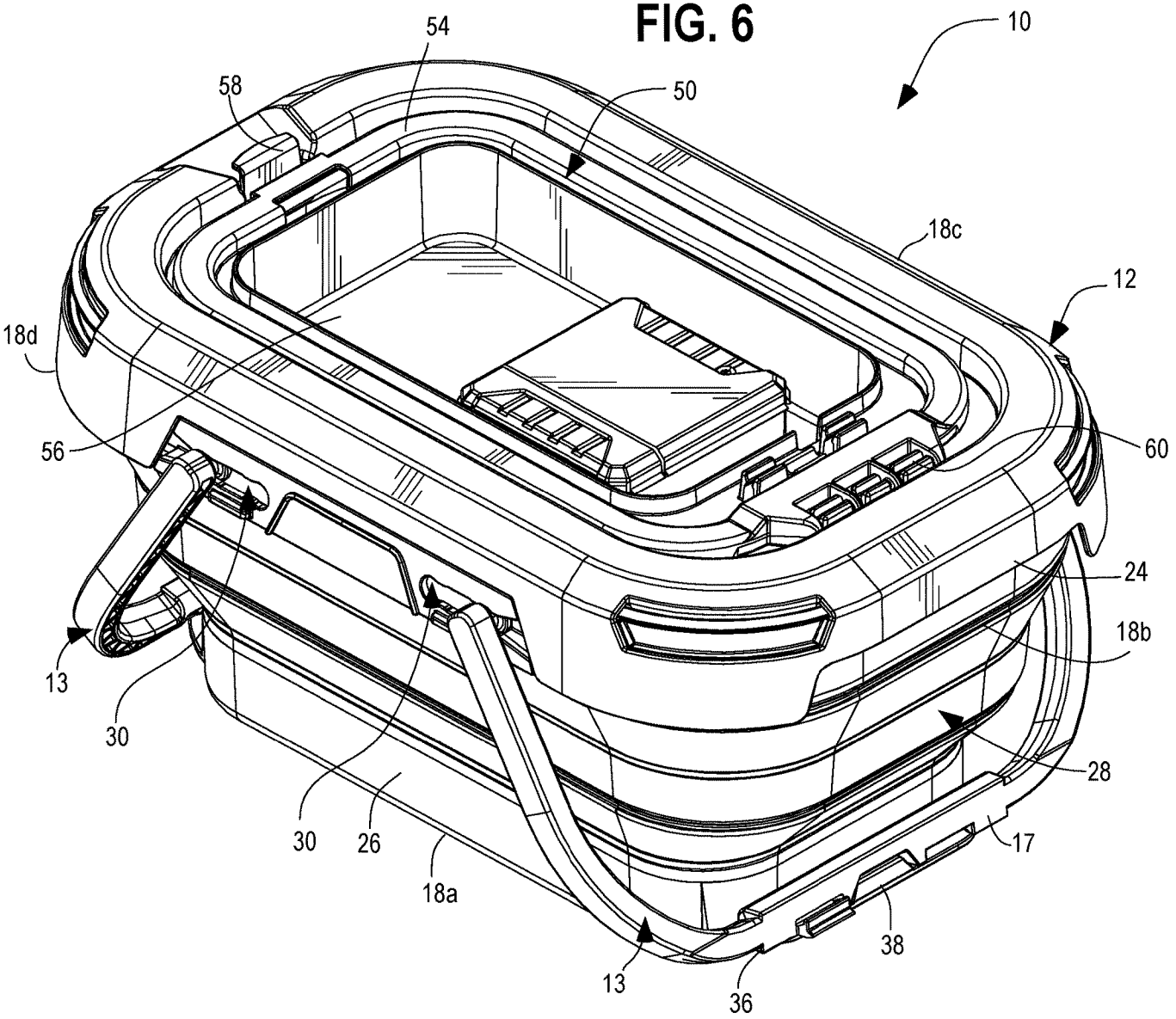
FIG. 6 is a perspective view of the collapsible container of FIG. 1 with a lid and the handles in a downward position, with the compartment cover of the lid removed.

Turning now to FIG. 6, the handle attachment channel 30 is illustrated on the first side 18*a* into which the knob 34 of the first handle end can be inserted. A second handle attachment channel 30 (not shown due to perspective) may be on the third side 18*c* into which the knob 34 of the second handle end can be inserted. The illustrated embodiment includes two handle attachment channels 30, one for each handle 13, in the first side 18*a* and two handle attachment channels 30 in the third side 18*c* (not shown due to perspective). In another embodiment, the channels 30 may be present on the second side 18*b* and the fourth side 18*d*.

The bottom portion 26 of the container 10 may also include handle holds 36. In some embodiments, the handle holds 36 can be molded into the bottom portion 26 or separately affixed thereto by any means known in the art. In general, the handle holds 36 can be any geometry that can releasably engage the handles 13 when the handles 13 are in the downward position. In the illustrated embodiment, an intermediate section 17 of the handles (i.e., the section between both ends of the handle) is engageable with the handle hold 36, although it is foreseen that different geometries of handles may require the handle hold 36 to capture a different section of the handle 13. In some embodiments, the handle holds 36 can be positioned on the side(s) adjacent to the handle attachment channels 30. For example, in the illustrated embodiment, the handle holds are positioned on the second side 18*b* and the fourth side 18*d* and the handle attachment channels 30 are positioned on the first side 18*a* and the third side 18*c*.

The handle hold 36 can releasably engage the handle by any acceptable means known in the art, for example, through snap fit, friction fit, or the like. In the illustrated embodiment, the handle hold 36 includes a deflectable lip 38 that engages the handle 13 until sufficient force is applied to the handle 13 to deflect the lip 38. The engagement of the handles 13 in the handle holds 36 can provide increased rigidity and support to the container 10 through their engagement with both the top portion 24 and the bottom portion 26 and may prevent or reduce the occurrence of an unintentional collapse of the container 10.

The lid 12 can be placed over the upper and lower rims 25*a*, 25*b* of the top portion 24 to create a secure connection therewith, for example, through a snap fit. The lid 12 can include a compartment cover 14 that is releasably coupled to the lid 12 (via lid cover 54) through, for example, a latch 15 (see FIG. 1). The side of the cover 14 opposing the latch 15 can be coupled to the lid 12 via a hinge 16, although other arrangements are also foreseen, such as, for example, a second latch.

The compartment cover 14, when opened, allows access to a lid compartment 50. The lid compartment 50 can be divided into segments with interior walls, as desired. Generally, the height of the lid compartment 50 is equal to or does not exceed the height of the lid 12 itself.

The lid 12 can also include a lid cover 54. The lid cover 54, when opened, allows access to the interior volume of the container 10 without fully removing the lid 12. The lid cover 54 can include side walls nested around the lid compartment 50, when the lid compartment 50 is present. In this way, the base of the lid cover 54 is adjacent to the base 56 of the lid compartment 50. When the lid cover 54 is moved (e.g., hinged open) or removed, the lid compartment 50 can also be moved or removed without additional effort. The lid cover 54 can be releasably coupled to the lid 12 through, for example, a latch 58. The side of the lid cover 54 opposing the latch 58 can be coupled to the lid 12 via a hinge 60, although other arrangements are also foreseen, such as, for example, a second latch.

As is evident from the foregoing description, certain aspects of the present invention is not limited by the particular details of the examples illustrated herein, and it is therefore contemplated that other modifications, applications, variations, or equivalents thereof, will occur to those skilled in the art. Many such changes, modifications, variations and other uses and applications of the present constructions will, however, become apparent to those skilled in the art after considering the specification and the accompanying drawings. In addition, unless mention was made above to the contrary, it should be noted that all of the accompanying drawings are not to scale. All such changes, modifications, variations and other uses in applications which do not depart from the spirit and scope of the present inventions are deemed to be covered by the inventions which are limited only by the claims which follow.

What is claimed is:

1. A collapsible container comprising:

a container body comprising a top portion, a bottom portion, and a middle portion between the top portion and the bottom portion, wherein the bottom portion comprises at least two handle holds on opposing sides of the body; and at least two handles rotatably coupled to the top portion, wherein the at least two handles are configured to releasably couple to the at least two handle holds, wherein a substantially middle portion of each of the at least two handles is received by each of the at least two handle holds;

wherein the middle portion is made of an elastic material such that a height of the container body can be reduced upon compression or folding of the middle portion, wherein each of the at least two handle holds comprises a deflectable lip configured to releasably engage the substantially middle portion of a respective one of the at least two handles until sufficient force is applied to deflect the deflectable lip, wherein the at least two handles are configured to releasably couple to the at least two handle holds when the collapsible container is in an expanded configuration to limit an unintentional collapse of the collapsible container.

2. The collapsible container of claim 1, wherein a width of the top portion is greater than a width of the bottom portion such that when the middle portion is compressed or folded, the top portion nests outside of the bottom portion.

3. The collapsible container of claim 1, wherein the top portion comprises at least two handle attachment channels to rotatably couple the at least two handles to the collapsible container.

4. The collapsible container of claim 3, wherein the at least two handle attachment channels comprise a first open end and a second closed end such that the at least two handles can be removed from the collapsible container.

5. The collapsible container of claim 1, further comprising a lid releasably engageable with the top portion.

6. The collapsible container of claim 5, wherein the lid further comprises a lid cover configured to allow access to an interior of the collapsible container when opened.

7. The collapsible container of claim 1, wherein the top portion terminates in an upper rim.

8. The collapsible container of claim 7, further comprising a lid releasably engageable to the upper rim of the top portion.

9. A collapsible container comprising:

a container body comprising a top portion, a bottom portion, and a middle portion between the top portion and the bottom portion, wherein the middle portion is made of an elastic material such that a height of the container body can be reduced upon compression or folding of the middle portion, wherein the bottom portion comprises at least two handle holds on opposing sides of the body;

at least two handles rotatably coupled to the top portion, wherein the at least two handles are coupled to the container body; and at least two handle attachment channels in which the at least two handles can be slidingly engaged, wherein when adjusting from a first position to a second position, the at least two handles slide inwardly from a first open end toward a second closed end, wherein when adjusting from the second position to the first portion, the at least two handles slide outwardly away from one another from the second closed end toward the first open end, and wherein when in the second position, the at least two handles abut the second closed end of the at least two handle attachment channels; and wherein the at least two handles comprise a first handle and a second handle, and an intermediate portion of the first handle is releasably couplable to an intermediate portion of the second handle, wherein the at least two handles are configured to releasably couple to the at least two handle holds when the collapsible container is in an expanded configuration to limit an unintentional collapse of the collapsible container.

10. The collapsible container of claim 9, wherein each of the at least two handle attachment channels comprises a first open end and a second closed end such that, when the at least two handles are in the second position, the at least two handles can be nestled substantially parallel to the collapsible container via the respective second closed ends.

11. The collapsible container of claim 10, wherein the at least two handles terminate in a knob coupled to a shaft, wherein the shaft is narrower than the knob.

12. The collapsible container of claim 11, wherein a width of the shaft is narrower than a width of the handle attachment channel.

* * * * *